US010920366B1

(12) United States Patent
Mulholland

(10) Patent No.: US 10,920,366 B1
(45) Date of Patent: Feb. 16, 2021

(54) BRASSIERE HOOK-AND-EYELET RETAINER FOR LAUNDRY APPLICATIONS

(71) Applicant: Lori Mulholland, Phoenix, AZ (US)

(72) Inventor: Lori Mulholland, Phoenix, AZ (US)

( * ) Notice: Subject to any disclaimer, the term of this patent is extended or adjusted under 35 U.S.C. 154(b) by 306 days.

(21) Appl. No.: 16/129,844

(22) Filed: Sep. 13, 2018

Related U.S. Application Data

(60) Provisional application No. 62/559,340, filed on Sep. 15, 2017.

(51) Int. Cl.
*D06F 95/00* (2006.01)
*A41F 1/00* (2006.01)

(52) U.S. Cl.
CPC ..... *D06F 95/008* (2013.01); *A41F 1/006* (2013.01)

(58) Field of Classification Search
CPC ..... D06F 95/008; A41F 1/006
See application file for complete search history.

(56) References Cited

U.S. PATENT DOCUMENTS

| | | | | |
|---|---|---|---|---|
| 3,757,388 | A | 9/1973 | Wolny | |
| 5,320,429 | A | 6/1994 | Toyosawa | |
| 5,829,083 | A | 11/1998 | Sutton | |
| 6,742,683 | B1 | 6/2004 | Phan | |
| 7,404,240 | B2 | 7/2008 | Ciccarelli et al. | |
| 7,591,156 | B2 | 9/2009 | Fenster | |
| 7,644,476 | B2 | 1/2010 | Takamura | |
| 7,647,795 | B2 | 1/2010 | Kitatani | |
| 7,922,046 | B2 | 4/2011 | Bemarco et al. | |
| 8,132,433 | B2 | 3/2012 | Andersen | |
| 9,269,816 | B2 | 2/2016 | Lin et al. | |
| 9,797,422 | B2 * | 10/2017 | Giannatti | F16B 2/10 |
| 2004/0226145 | A1 | 11/2004 | Ouellette et al. | |
| 2004/0264815 | A1 | 12/2004 | Gibeau | |
| 2005/0144765 | A1 * | 7/2005 | Anderson | D06F 95/008 24/556 |
| 2007/0241103 | A1 * | 10/2007 | Kaylor | D06F 95/008 220/4.22 |
| 2011/0143635 | A1 * | 6/2011 | Brydon | A44C 25/001 450/86 |
| 2012/0030863 | A1 | 2/2012 | Marasco et al. | |
| 2015/0250270 | A1 | 9/2015 | Tang | |
| 2016/0366964 | A1 | 12/2016 | Eddy et al. | |

FOREIGN PATENT DOCUMENTS

| | | | |
|---|---|---|---|
| WO | 2011080145 | A1 | 7/2007 |

* cited by examiner

*Primary Examiner* — Jack W Lavinder
(74) *Attorney, Agent, or Firm* — Invention To Patent Services; Alex Hobson

(57) ABSTRACT

A hook-and-eyelet retainer protects a brassiere hook-and-eyelet clasp from becoming detached in the laundry to prevent damage to the brassiere, other undergarments in the laundry and/or the laundry machine. A hook-and-eyelet retainer has a first and a second retainer portion that are coupled together by a hinge. The first and second retainer portions pivot about the hinge to receive a hook-and-eyelet clasp and wing band. The hook-and-eyelet retainer is then closed and a post on a first retainer portion extends through a closure aperture on a second retainer portion to secure the hook-and-eyelet retainer in a closed position. A plurality of teeth extends up from one or both of the retainer portions to grip onto the hook-and-eyelet clasp and/or the wing band. One or both of the planar retainer portions may be recessed to accommodate the thickness of the brassiere hook-and-eyelet clasp or clasp strap or hook-and-eyelet and wing band.

14 Claims, 11 Drawing Sheets

BRASSIERE HOOK-AND-EYELET RETAINER FOR LAUNDRY APPLICATIONS

CROSS REFERENCE TO RELATED APPLICATIONS

This application claims the benefit of priority to U.S. provisional patent application No. 62/559,340, filed on Sep. 15, 2017; the entirety of which is hereby incorporated by reference herein.

BACKGROUND OF THE INVENTION

Field of the Invention

The invention is directed to a brassiere hook-and-eyelet retainer for laundry applications.

Background

Most brassieres have a hook and eyelet clasp to secure the brassiere behind a woman's torso. The clasp is usually metal and the agitation in the laundry machine can cause this hook and eyelet to become unhooked, and damage the brassiere, other garments in the laundry machine or the laundry machine. Brassieres often comprise lacy and delicate materials that may be snagged by a detached or decoupled hook of a hook-and-eyelet clasp, resulting in damage.

There are a number of enclosures for laundering delicate articles including undergarments. These enclosures are bags or rigid objects for placing the entire delicate undergarment and/or brassieres within the enclosure. The article is restricted in these enclosures, which can result in reduced cleaning effectiveness of laundering, and soap may not rinse completely out of the article.

SUMMARY OF THE INVENTION

The invention is directed to a brassiere hook-and-eyelet retainer for laundry applications. An exemplary brassiere hook-and-eyelet retainer comprises a first planar retainer portion coupled to a second planar retainer portion by a hinge. The first and/or second planar retainer portion comprises teeth that extend up from the planar surface to grip onto the hook-and-eyelet and/or the wing band, or strap attached to the hook-and-eyelet. A plurality of teeth may be configured substantially over the planar surface of both the first and second planar retainer portions. A first and/or second planar portion may comprise five or more, ten or more or twenty or more teeth and any range between and including the number of teeth provided. The plurality of teeth may be configured over a majority of the surface area of the planar portion, wherein a perimeter around the plurality of teeth encompasses at least 50% of the surface area of an inside surface of the planar portion, and the perimeter around the plurality of teeth may encompass about 70% or more or about 80% or more of the area of the planar portion. The plurality of teeth may be arranged substantially over a majority of the inside surface area of planar portion to enable secure retention to the wing band or strap of the brassiere. Teeth arranged over a limited area or in single line may not provide effective retention to the brassiere during laundering. Exemplary teeth may be tapered from a connected end to an extended end and may be at least partially conical in shape, such as at the tip. The first or second planar retainer portion may be recessed having a wall that extends around the perimeter of the planar portion.

An exemplary brassiere hook-and-eyelet retainer comprises a closure comprising one or more posts that extend up from one of the planar retainer portions and corresponding closure apertures, or slots, in the opposing planar retainer portion for receiving and retaining the posts when they are extended through the closure slots. The closure apertures may be closure slots to allow dosing and securing the brassiere hook-and-eyelet retainer in a closed position when the planar sections deflect or bend around a hook-and-eyelet within the retainer. An exemplary closure slot may have a length to accommodate the deflection of the planar portions and allow the closure post to extend therethrough when one or more of the planar portions are deflected or curved around a wing band. The closure slots may have a length from a hinge end to an extended end of about 5 mm or more, about 8 mm or more, about 10 mm or more, about 12 mm or more, about 15 mm or more, about 20 mm or more and any range between and including the closure slot lengths provided. An exemplary post may have an enlarged extended end that is larger in dimension than the post extension that is connected to the retainer portion and extends up to the enlarged extended end. An enlarged extended end may be spherical in shape, or curved to allow it to fit through the closure aperture and may have a cross-slot dimension, such as diameter of the enlarged extended end, that is slightly larger than the width of the closure slot, such as about 2% larger or more, about 5% larger, up to about 5% larger and the like. The closure slot may deflect to enable the enlarged extended end of the post to fit through the closure slot. The post may have a length that is greater than a wall height around the perimeter of the retainer portion. The post is longer than the teeth to allow penetration through the closure aperture.

An exemplary hinge enables the first and second retainer portions to pivot open and closed. An exemplary hinge also enables the first and second retainer portions to be detached from each other. An exemplary hinge comprises a rod on one of the retainer portions and a cylindrical cup on the other retainer portion. The cylindrical cup is a partial cylinder having an opening or opening slot along the length of the cylinder for attachment around the rod. The cylindrical cup may be snap fit around the rod whereby when the first and second retainer portions rotate toward each other, the cylindrical cup rotates to a position that prevents it from becoming detached from the rod. This unique hinge structure enables the two planar parts to be made separately through injection molding and then subsequently attached for use. The rod may be cylindrical in shape to facilitate rotation of the cylindrical cup therearound. An exemplary hinge may be a living-hinge that consists of plastic material extending between the first and second retainer portions. An exemplary living-hinge may comprise a recessed or thinner portion of material that extends along the length of the hinge between the hinge ends of the first and second retainer portions to facilitate deflection and rotation about the living hinge. An exemplary hook-and-eyelet retainer having a living-hinge is a one-piece unit that is not detachably attachable and may be made from a single plastic mold and from a single type of material.

An exemplary hook-and-eyelet retainer is sized to accommodate a variety of brassiere hook-and-eyelet clasps and may have a length from a hinge end to an extended end of about 1 inch or more, about 1.5 inches or more, about 2 inches or more, about 3 inches or more, about 4 inches or more, about 5 inches or more and any length between and including the length values provided. Likewise, the width of an exemplary hook-and-eyelet retainer may be about 0.5 inch or more, about 1 inch or more, about 2 inches or more, about 3 inches or more, about 4 inches or more, about 5 inches or more and any length between and including the width values provided. One of the first or second retainer portions may be longer than the other retainer portion thereby producing an overhang portion that facilitates opening of the hook-and-eyelet retainer, as the overhang portion may be pulled with respect to the opposing retainer portion.

An exemplary brassiere hook-and-eyelet retainer may be made out of any suitable material including, but not limited to, plastic, metal, elastomer, composites and the like. A preferred material however, may be plastic as it may be more resistant to degradation from exposure to repeated laundering cycles. An exemplary brassiere hook-and-eyelet retainer may be made out of polyethylene, polypropylene, ABS and the like.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention and together with the description serve to explain the principles of the invention.

Figure 1:
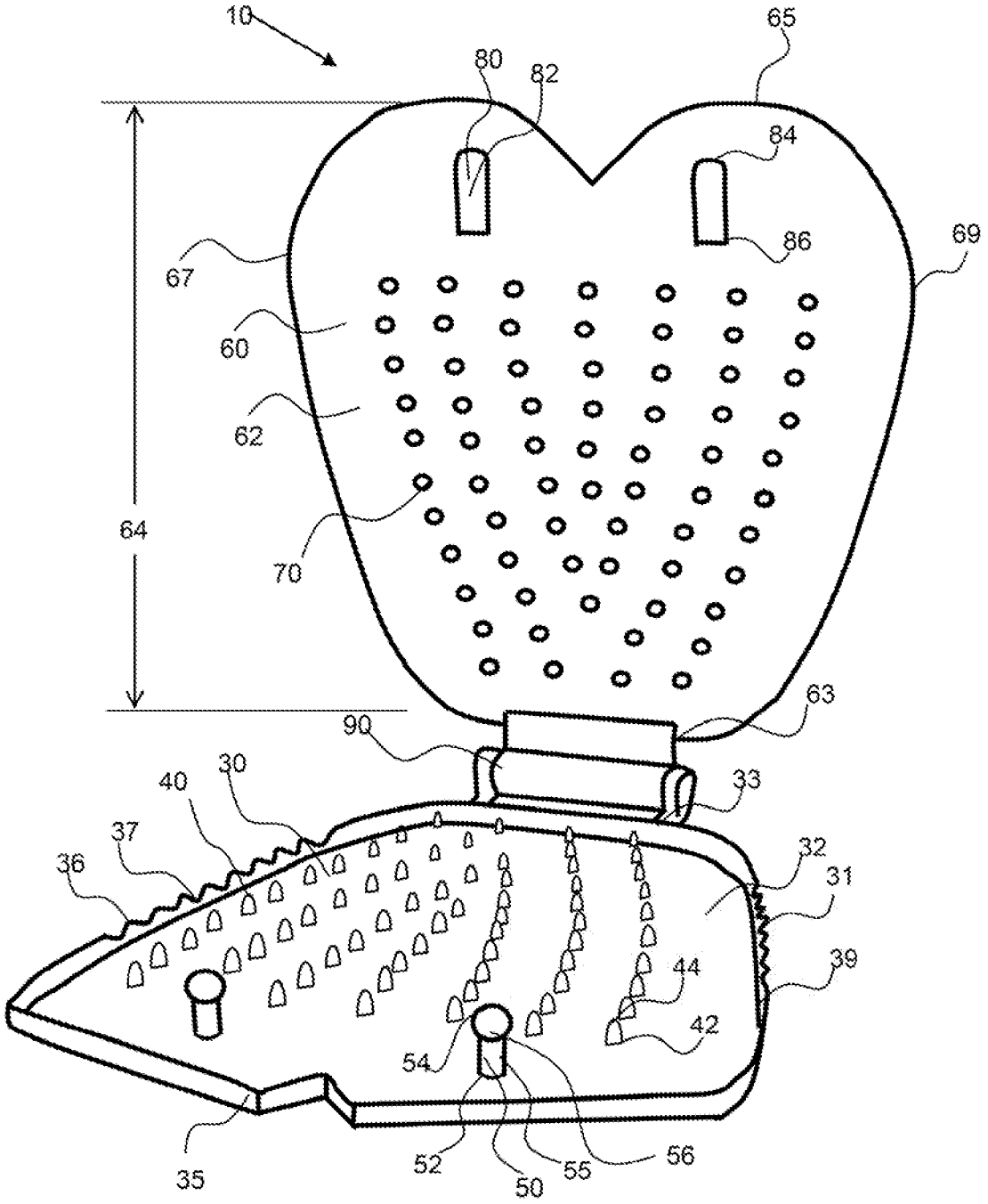
FIG. 1 shows a perspective view of an exemplary brassiere hook-and-eyelet retainer having a first retainer portion and a second retainer portion in an open configuration.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. In addition, use of "a" or "an" are employed to describe elements and components described herein. This is for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an exemplary brassiere hook-and-eyelet retainer 10 has a first retainer portion 30 and a second retainer portion 60 in an open configuration. The first retainer portion and second retainer portion are coupled together by a hinge 90. The first retainer portion has a length from a hinge end 33 to an extended end 35. Likewise, the second retainer portion has a length from a hinge end 63 to an extended end 65. The exemplary first retainer portion has a planar retainer portion 32 that is recessed with a wall 31 extending up around the perimeter of the planar retainer portion. A plurality of first teeth 40 extend up from the planar retainer portion 32 and are tapered along the length of the teeth from the connected end 42 to the extended end 44. A pair of posts 50 also extend up from the planar retainer portion 32. The posts have a length from a connected end 52 to the extended end 54. Each post has an enlarged extended end 56 that is larger in dimension than the post extension 55 and as shown is spherical in shape. The enlarged extended ends of the posts are configured to extend through the closure apertures 80 in the second retainer portion 60. The closure apertures 80 are closure slots 82, having a length from an extended end 84 to a hinge end 86. The second retainer portion 60 has a planar retainer portion 62 and a plurality of teeth 70 that extend up from the planar retainer portion 62, like the teeth shown on the first retainer portion. The teeth on the second retainer portion also have alength from connected end to an extended end and the teeth taper along the length to the extended end. The first retainer portion has a width from a first side 37 to a second side 39 and the second retainer portion has a width from a first side 67 to a second side 69. The width of both the first and second retainer portions reduces or tapers as toward the hinge ends. The wall 31 may comprise a serrated wall portion 36 to retain the wing band, as it will have to conform around the serrated wall portion.

Figure 2:
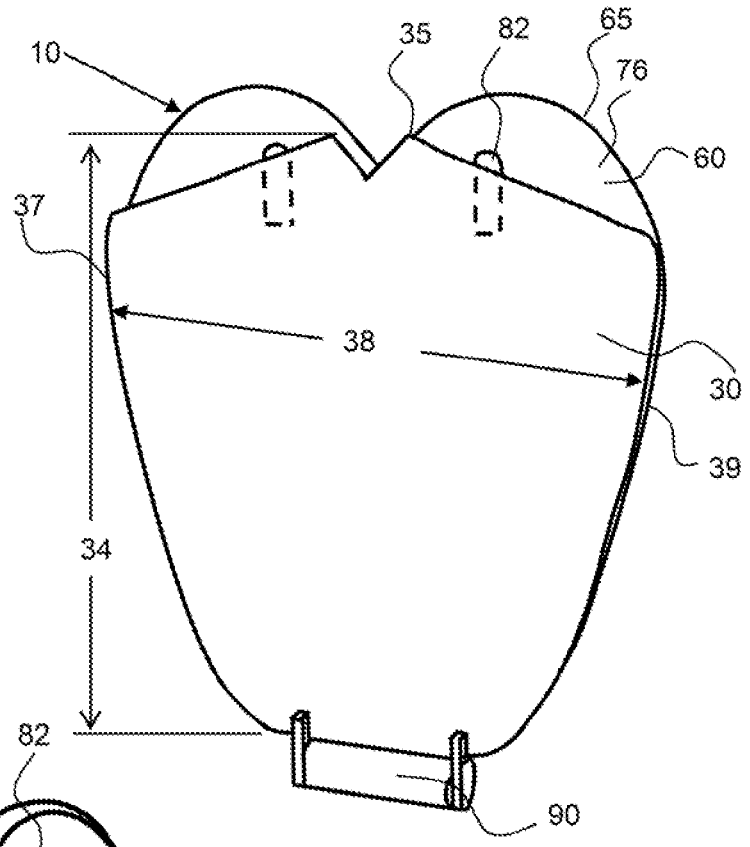
FIG. 2 shows a front view of an exemplary brassiere hook-and-eyelet retainer in a closed position with the closure posts extended through the closure apertures.

As shown in FIG. 2, an exemplary brassiere hook-and-eyelet retainer 10 is configured in a closed position with the posts extending through the closure slots 82. The second retainer portion 60 extends further from the hinge 90 than the first retainer portion 30, or it is longer than the first retainer portion. This overhanging portion 76 allows the brassiere hook-and-eyelet retainer to be opened more easily.

Figure 3:
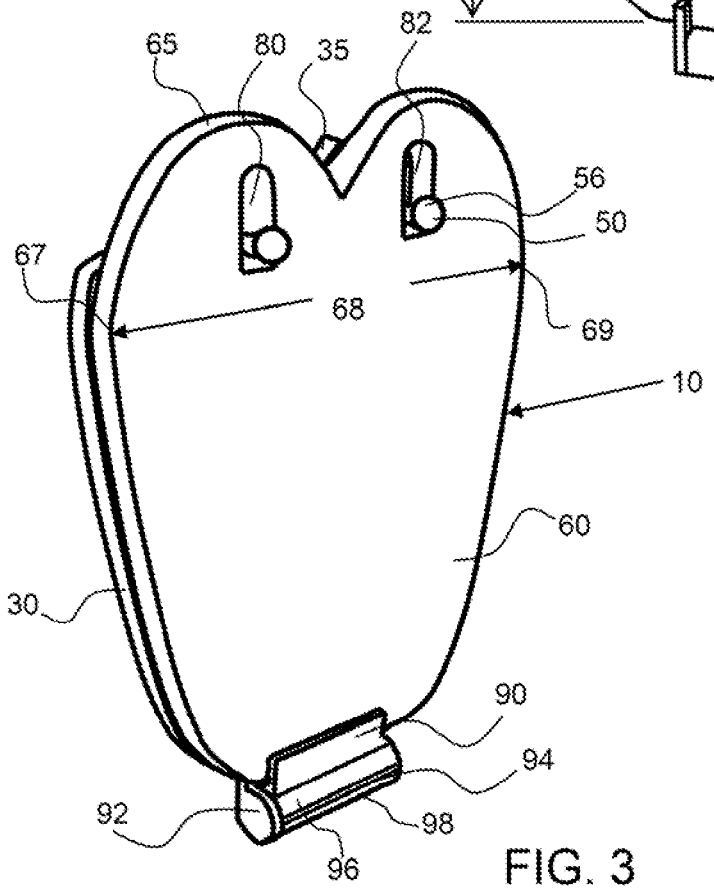
FIG. 3 shows a back view of an exemplary brassiere hook-and-eyelet retainer in a closed position.

As shown in FIG. 3 an exemplary brassiere hook-and-eyelet retainer 10 is configured in a closed position with the enlarged extended ends 56 of the post 50 projected through the closure slots 82. The closure slots allow for closing the brassiere hook-and-eyelet retainer around a thick brassiere hook-and-eyelet that causes the planar retainer portions to flex and deflect around the hook-and-eyelet. The hinge 90 comprises a first hinge portion 92 that is part of the first retainer portion 30 and a second hinge portion 94 that is part of the second retainer portion 60. The first hinge portion is a rod 96 and the second hinge portion is cylindrical cup 98, as more clearly shown in FIG. 4. Note that the rod may be configured on the second retainer portion and the cylindrical cup may be configured on the first retainer portion.

Figure 4:
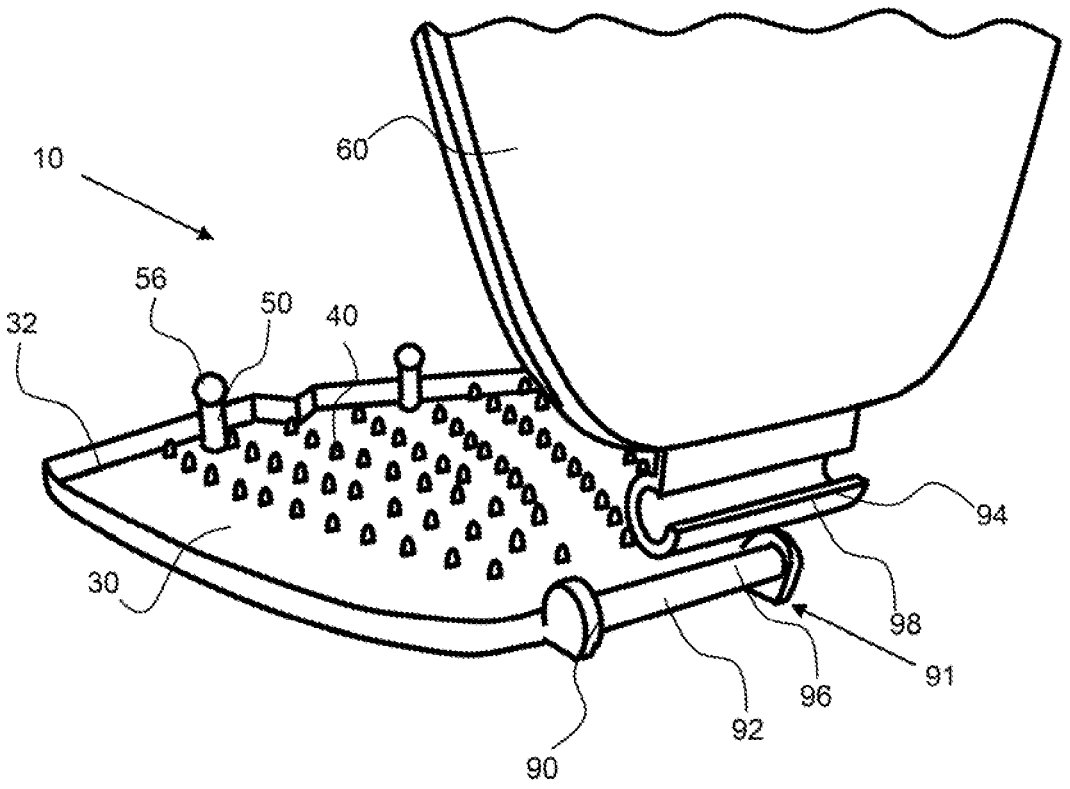
FIG. 4 shows a back end view of an exemplary brassiere hook-and-eyelet retainer having the first retainer portion and a second retainer portion detached and the a rod-cup hinge wherein the first retainer portion has a rod and the second hinge portion has cylindrical cup thereby producing a rod-cup hinge.

As shown in FIG. 4, an exemplary brassiere hook-and-eyelet retainer 10 has the first retainer portion 30 and a second retainer portion 60 detached. The exemplary rod-cup hinge 91 comprises a post 96 and a cylindrical cup 98. The cylindrical cup snap fits around the post to produce the hinge. The rod-cup hinge can be decoupled by rotating the first and second retainer and pulling the cylindrical cup from the post.

Figure 5:
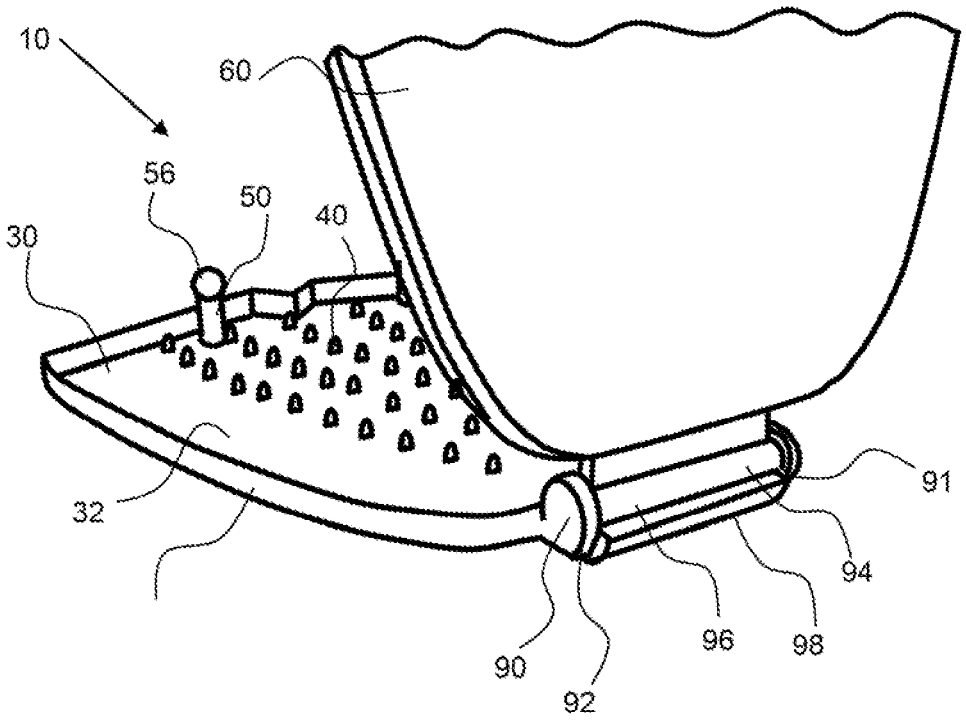
FIG. 5 shows the exemplary brassiere hook-and-eyelet retainer shown in FIG. 4 now attached by the rod-cup hinge.

As shown in FIG. 5, the exemplary brassiere hook-and-eyelet retainer 10 shown in FIG. 4 is now attached by the rod-cup hinge 91.

Figure 6:
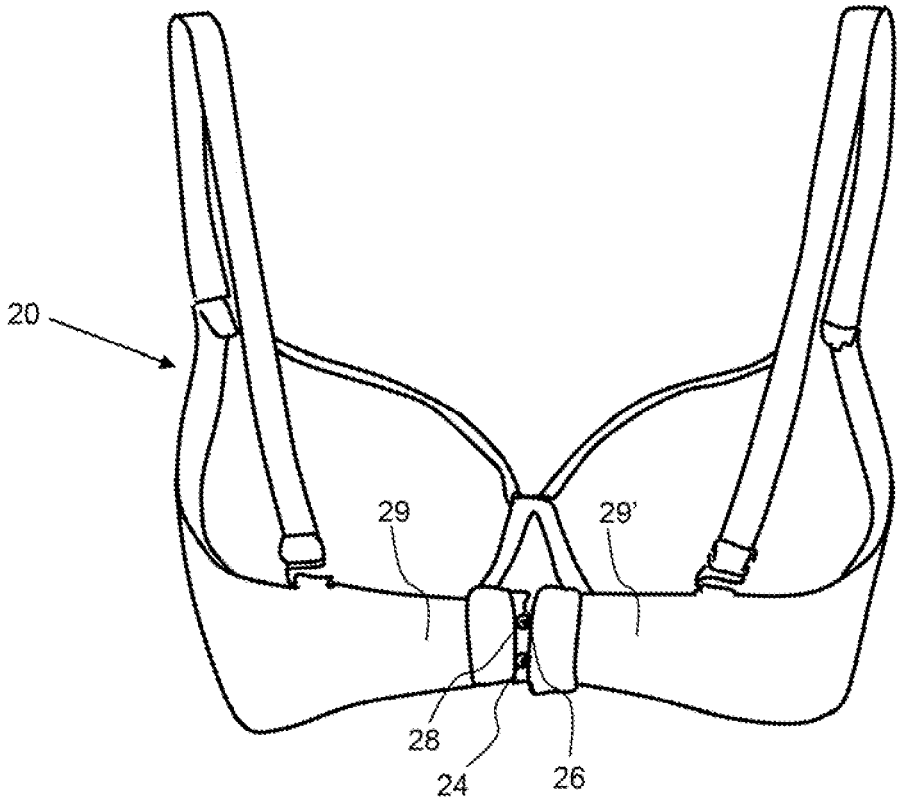
FIG. 6 shows an exemplary brassiere having a hook-and-eyelet attachment mechanism comprising a hook and an eyelet.

As shown in FIG. 6, an exemplary brassiere 20 has a hook-and-eyelet clasp 24 comprising a hook 26 and an eyelet 28.

Figure 7:
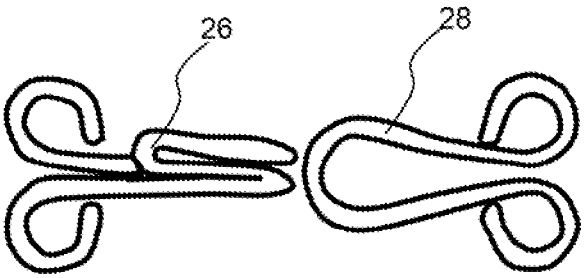
FIG. 7 shows an exemplary hook and eyelet detached.

As shown in FIG. 7, an exemplary hook 26 and eyelet 28 are detached.

Figure 8:
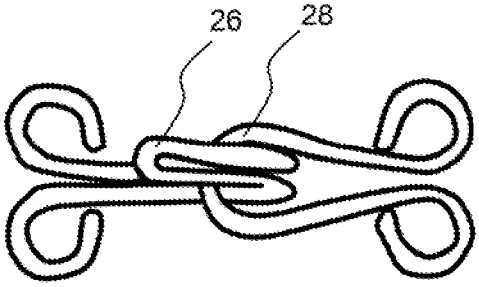
FIG. 8 shows an exemplary hook and eyelet attached with the hook configured through the eyelet.

As shown in FIG. 8, an exemplary hook 26 and eyelet 28 are attached with the hook configured through the eyelet to produce a hook-and-eyelet clasp 24

Figure 9:
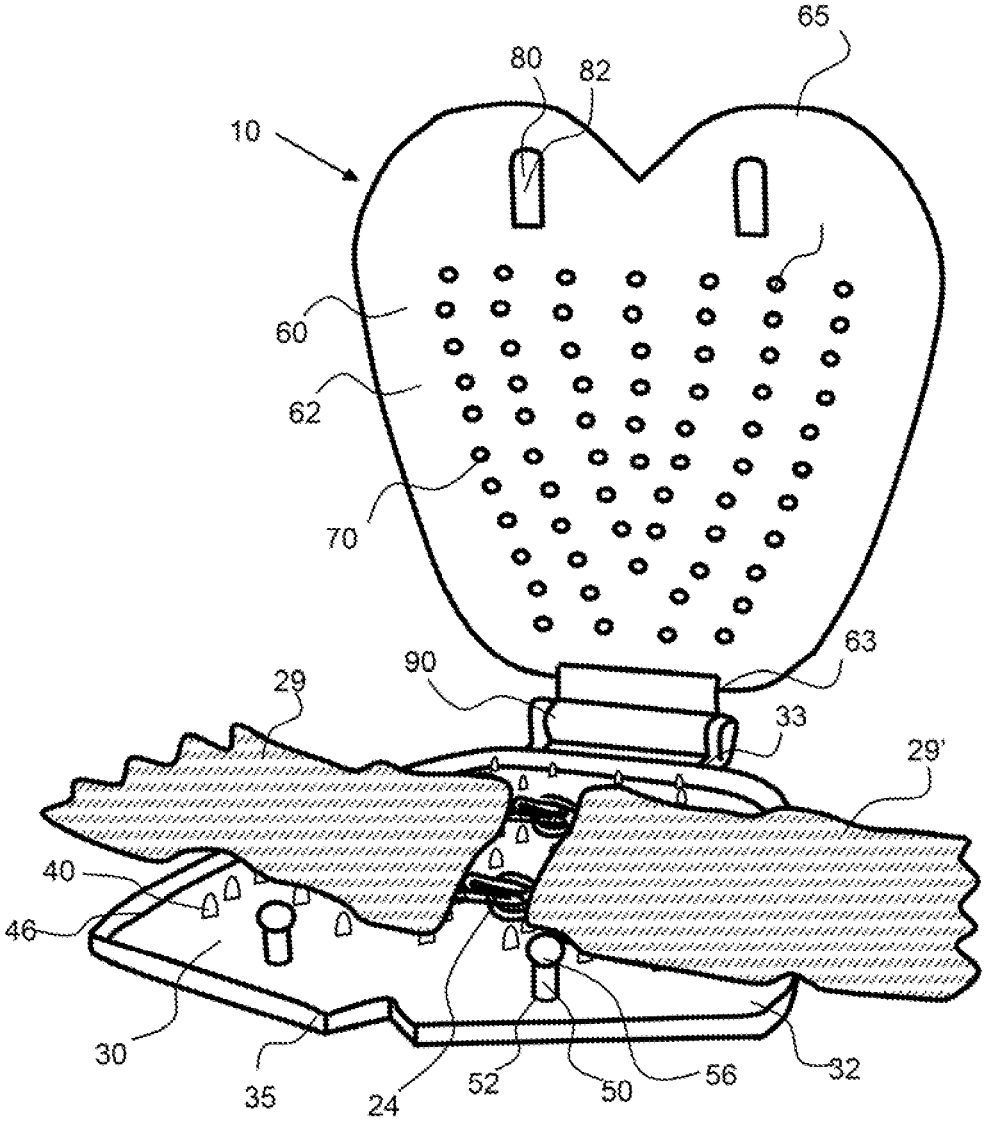
FIG. 9 shows a perspective view of an exemplary brassiere hook-and-eyelet retainer having a first retainer portion and a second retainer portion in an open configuration and a brassiere wing band and hook-and-eyelet configured within the brassiere hook-and-eyelet retainer.

As shown in FIG. 9, an exemplary brassiere hook-and-eyelet retainer 10 has a first retainer portion 30 and a second retainer portion 60 in an open configuration and a brassiere hook-and-eyelet clasp 24 configured within the brassiere hook-and-eyelet retainer. The teeth of the first and second retainer portions 40, 70 respectively will grip the hook-and-eyelet clasp 24 as well as the wing band 29, 29' and prevent it from pulling out from the brassiere hook-and-eyelet retainer 10.

Figure 10:
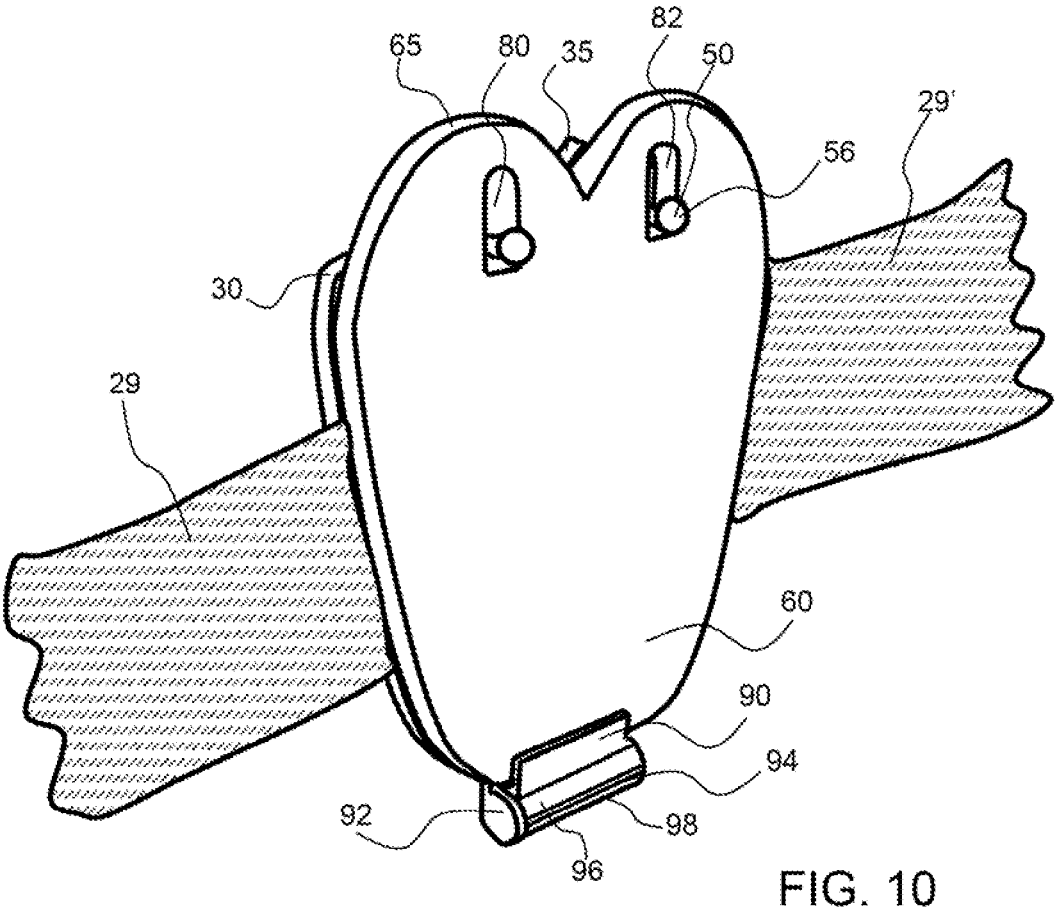
FIG. 10 shows a back view of an exemplary brassiere hook-and-eyelet retainer in a closed position with a brassiere hook-and-eyelet configured therein and the closure posts extended through the closure apertures.

As shown in FIG. 10, an exemplary brassiere hook-and-eyelet retainer 10 is in a closed position with a brassiere hook-and-eyelet clasp configured therein and the closure posts 50 extended through the closure apertures 80. The clasp straps or wing bands 29, 29' are extending out from the hook-and-eyelet retainer 10.

Figure 11:
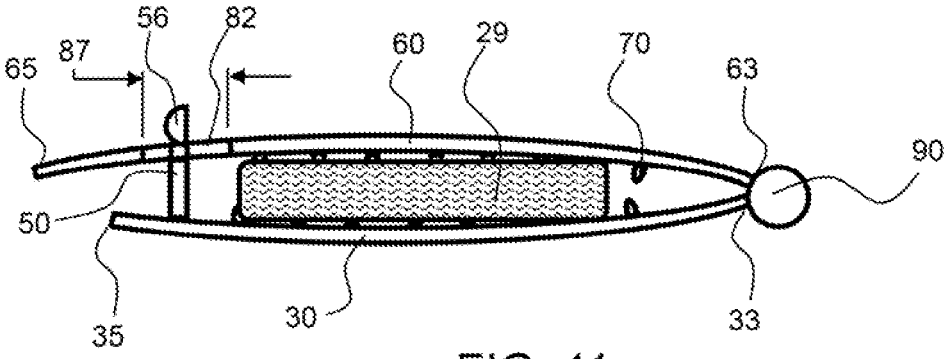
FIG. 11 shows a side view of an exemplary brassiere hook-and-eyelet retainer in a closed position with a brassiere hook-and-eyelet configured therein and the closure posts extended through the closure apertures

As shown in FIG. 11, the first and second planar retainer portions 32 62 of the first and second retainer portions 30, 60 respectively, are bowed around the wing band 29. The curved plastic deformation of the planar portions changes the location along the length 87 of the closure slot 82 where the enlarged extended end 56 of the post 50 is retained in the slot. The length of the slot is therefore configured to accommodate this curvature of the planar portions around the wing band. In this embodiment, both the first and second planar retainer portions 32, 62 are curved, or plastically deformed around the wing band. The plurality of teeth 70 are engaged into the wing band 29 to retrain it in the brassiere hook-and-eyelet retainer 10.

Figure 12:
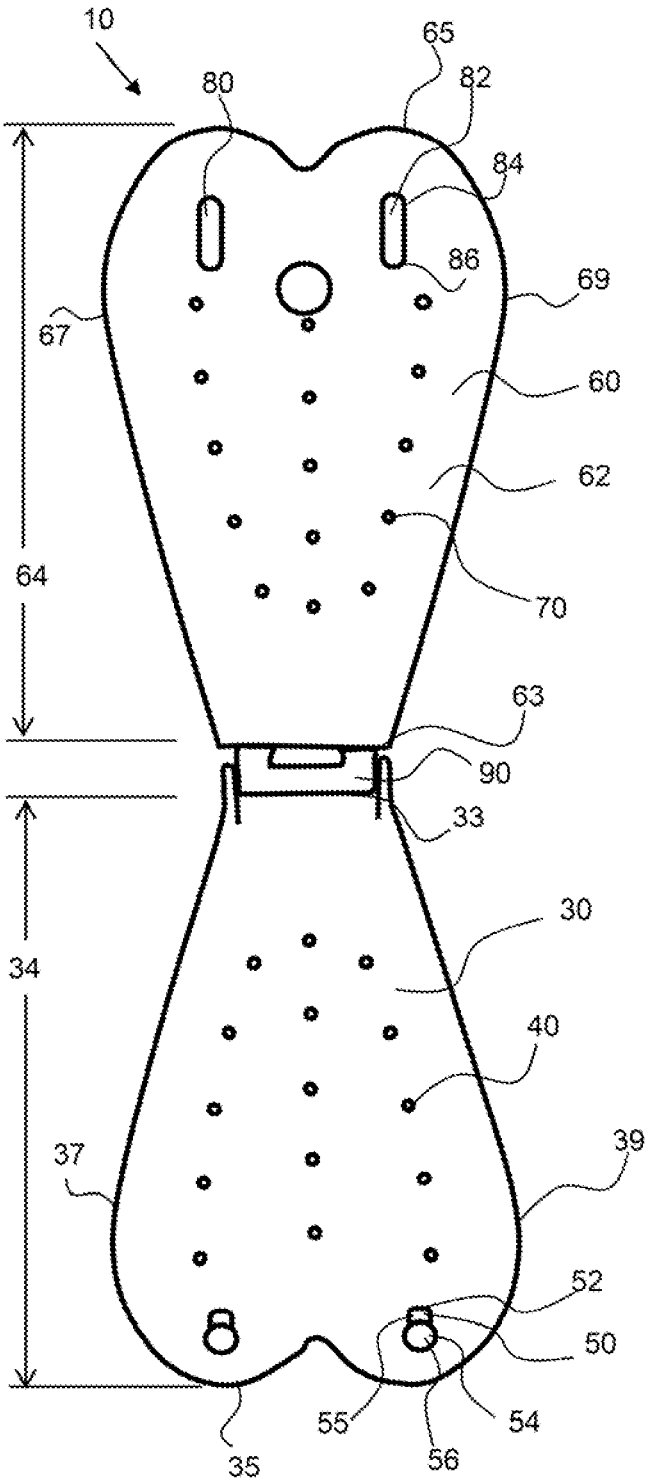
FIG. 12 shows a top view of an exemplary brassiere hook-and-eyelet retainer in an open position.
Figure 13:
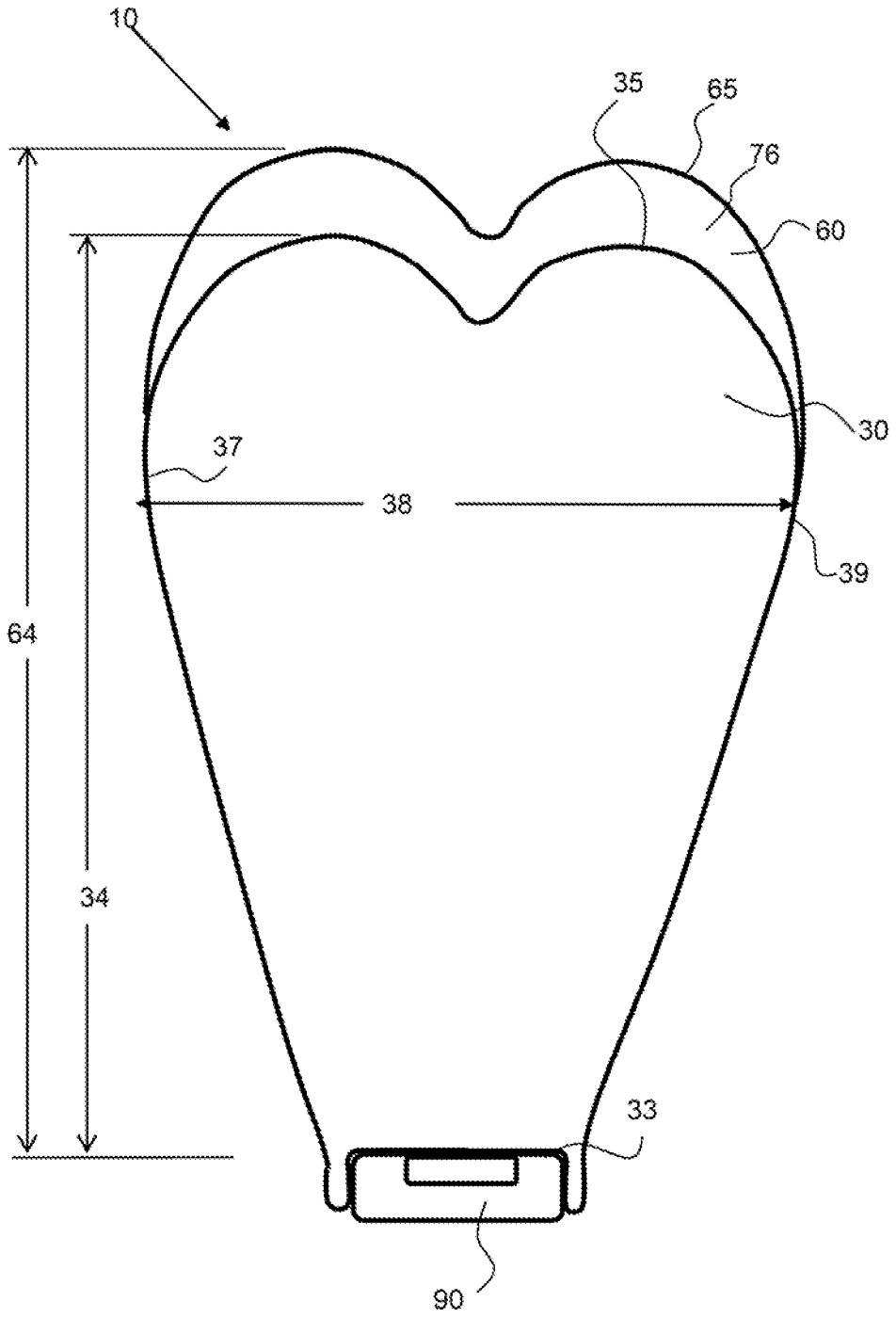
FIG. 13 shows a front view of an exemplary brassiere hook-and-eyelet retainer in a closed position.
Figure 14:
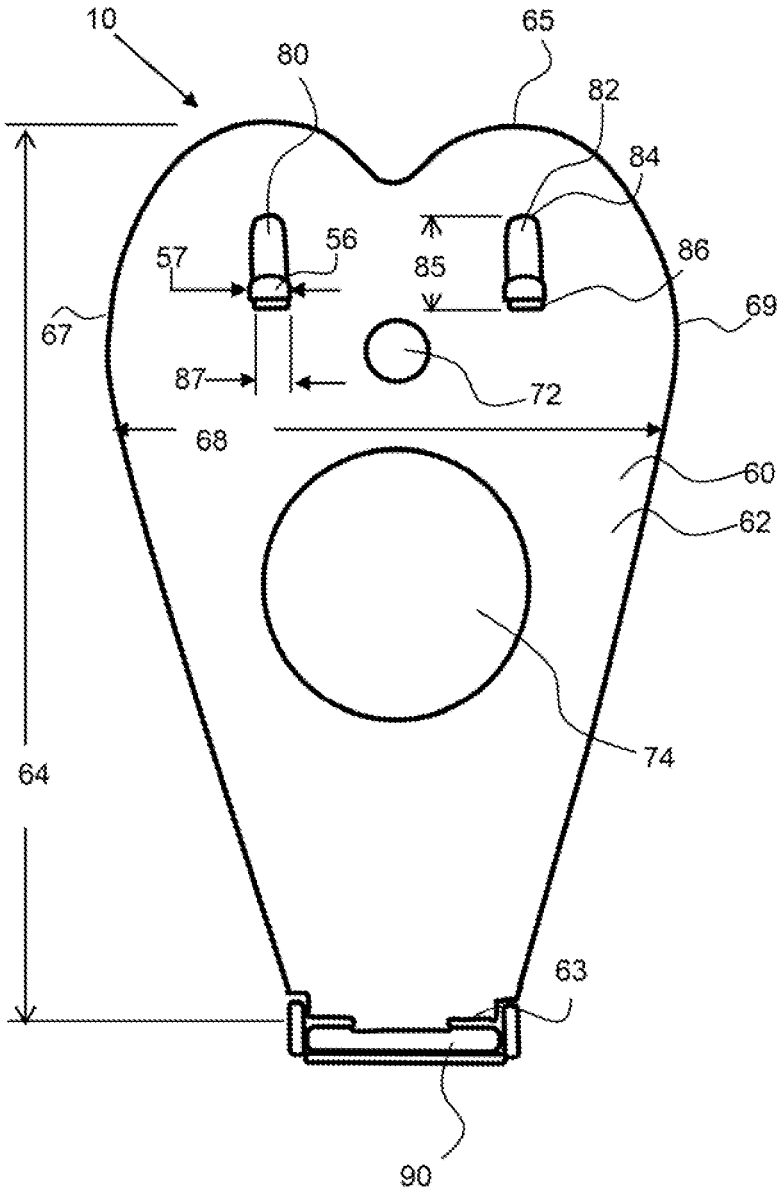
FIG. 14 shows a back view of an exemplary brassiere hook-and-eyelet retainer in a closed position with the closure posts extended through the closure apertures.

Referring now to FIGS. 12 to 14, an exemplary brassiere hook-and-eyelet retainer 10 has a first retainer portion 30 and a second retainer portion 60 in an open configuration. The first retainer portion and second retainer portion are coupled together by a hinge 90. The first retainer portion has a length 34 from a hinge end 33 to an extended end 35. Likewise, the second retainer portion has a length 64 from a hinge end 63 to an extended end 65. The exemplary first retainer portion has a planar retainer portion 32. A plurality of first teeth 40 extend up from the planar retainer portion 32 and are tapered along the length of the teeth from the connected end to the extended end. A pair of posts 50 also extend up from the planar retainer portion 32. The posts have a length from a connected end 52 to the extended end 54. Each post has an enlarged extended end 56 that is larger in dimension than the post extension 55 and as shown is spherical in shape. The enlarged extended ends of the posts are configured to extend through the closure apertures 80 in the second retainer portion 60. The closure apertures 80 are closure slots 82, having a length from an extended end 84 to a hinge end 86. The second retainer portion 60 has a planar retainer portion 62 and a plurality of teeth 70 that extend up from the planar retainer portion 62, like the teeth shown on the first retainer portion. The teeth on the second retainer portion also have a length from connected end to an extended end and the teeth taper along the length to the extended end. Exemplary teeth may be conical in shape. The first retainer portion has a width 38 from a first side 37 to a second side 39 and the second retainer portion has a width 68 from a first side 67 to a second side 69. The width of both the first and second retainer portions reduces or tapers toward the hinge ends. Both the first and second retainer portions have a heart shape, wherein the width flares out from the hinge end and has two curved portions, or radiused portions, at the extended ends. The second retainer portion 60 is longer than the first retainer portion 30, thereby creating an overhang portion 76 of the second retainer portion 60, the planar retainer portion 62.

As shown in FIG. 14, the closure slots 82 have a length 85 to accommodate flex and curvature of the first retainer portion 30 and or the second retainer portion 60. The cross-slot dimension 57 of the enlarged extended end 56 of the closure post is slightly larger than the width 87 of the closure slot 82; thereby requiring the sides of the closure slot to flex to allow insertion and removal of the enlarged extended end through the closure slot. The back of the second retainer portion comprises a depression 74 that may be configured for receiving a sticker or other attachment. Also, the second retainer portion 60 has a window 72, an aperture through the planar retainer portion 62.

Figure 15:
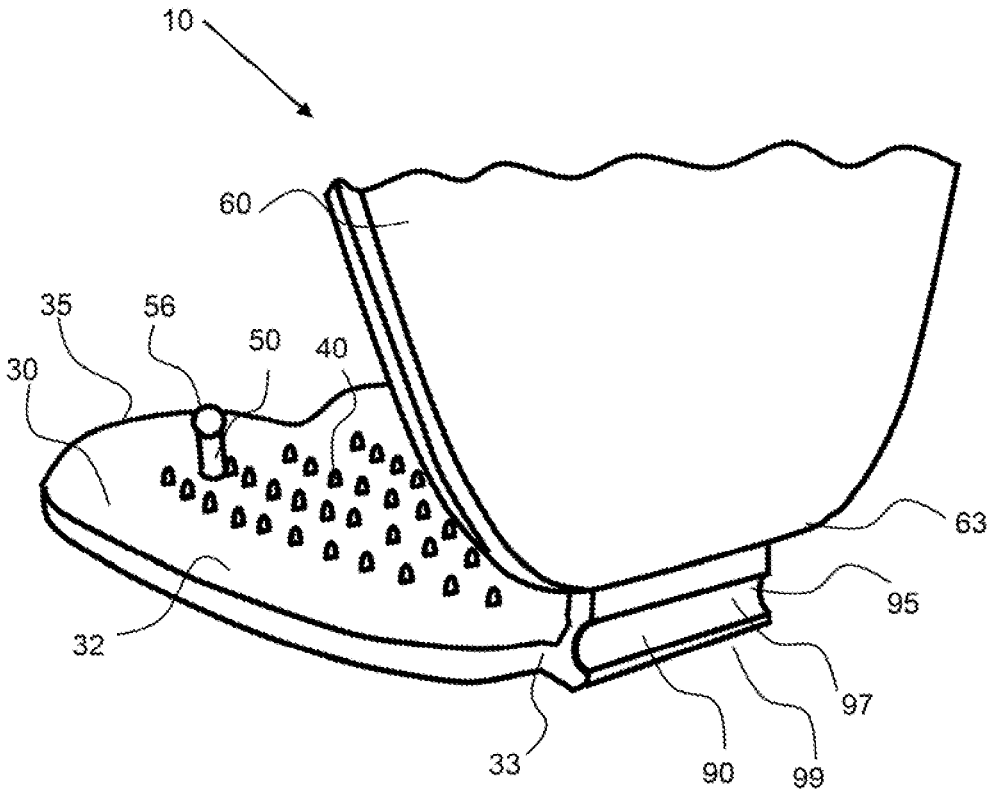
FIG. 15 shows a back end view of an exemplary brassiere hook-and-eyelet retainer having a living hinge.

As shown in FIG. 15 an exemplary brassiere hook-and-eyelet retainer 10 has a living hinge 99 comprising a recessed portion 97, or a thinner portion 95 in the hinge area to allow the first and second retainer portions to easily flex about the living hinge.

It will be apparent to those skilled in the art that various modifications, combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A method of protecting a brassiere hook-and-eyelet clasp during laundering comprising the steps of:

a) providing a brassiere hook-and-eyelet retainer comprising:
   i) a first retainer portion comprising:
      a first planar retainer portion having a retainer area;
      a closure post that extends up from the planar retainer portion;
   ii) a second retainer portion comprising:
      a second planar retainer portion having a retainer area;
      a closure aperture for receiving the closure post when the brassiere hook-and-eyelet retainer is in a closed position;
   iii) a hinge between the first and second retainer portions;
   wherein the first and second retainer portions are rotatable about said hinge;
   wherein the first and second retainer portions are rotatable apart about the hinge to an open position, and rotatable together with the closure post extending through the closure aperture to a closed position;
b) providing a brassiere having a hook-and-eyelet clasp comprising:
   i) a first end;
   ii) a second end;
c) clasping the first end of the hook-and-eyelet clasp to the second end,
d) placing the hook-and-eyelet clasp into the open brassiere hook-and-eyelet retainer between the first and second retainer portions,
e) closing the first and second retainer portions to a closed position with the closure post inserted through the closure aperture,
f) laundering the brassiere.

2. The method of protecting a brassiere hook-and-eyelet clasp during laundering of claim 1, wherein at least one of the first or second retainer portions further comprises a plurality of teeth that extend up from the retainer area.

3. The method of protecting a brassiere hook-and-eyelet clasp during laundering of claim 1, wherein the first retainer portion further comprises a plurality of teeth that extend up from the retainer area of the first retainer portion; and wherein the second retainer portion further comprises a plurality of teeth that extend up from the retainer area of the second retainer portion.

4. The method of protecting a brassiere hook-and-eyelet clasp during laundering of claim 3, wherein the plurality of teeth of the first and second retainer portions are tapered from a connected end to an extended end.

5. The method of protecting a brassiere hook-and-eyelet clasp during laundering of claim 3, wherein the each of the first and second retainer portions have at least 10 teeth.

6. The method of protecting a brassiere hook-and-eyelet clasp during laundering of claim 1, wherein the first retainer portion and second retainer portion are detachably attachable.

7. The method of protecting a brassiere hook-and-eyelet clasp during laundering of claim 6, wherein the hinge is a rod-cup hinge and comprises:

a) a first hinge portion that is a rod; and
b) a second hinge portion is a cylindrical cup;
wherein the rod is configured within the cylindrical cup.

8. The method of protecting a brassiere hook-and-eyelet clasp during laundering of claim 1, wherein the closure post has an enlarged extended end.

9. The method of protecting a brassiere hook-and-eyelet clasp during laundering of claim 1, wherein the closure aperture is a closure slot.

10. The method of protecting a brassiere hook-and-eyelet clasp during laundering of claim 1, wherein the first retainer portion comprises two closure posts and the second retainer portion comprises two closure apertures and wherein each of the closure apertures are closure slots.

11. The method of protecting a brassiere hook-and-eyelet clasp during laundering of claim 1, wherein the first or second retainer portions have extended ends opposite the hinge and wherein the extended end of one of the first and second retainer portions extends further from the hinge than the extended end of the other of the first and second retainer portion, thereby creating an overhang portion when in a closed position.

12. The method of protecting a brassiere hook-and-eyelet clasp during laundering of claim 1, further comprising a perimeter wall around one of the first and second retainer portions.

13. The method of protecting a brassiere hook-and-eyelet clasp during laundering of claim 12, wherein the plurality of teeth of the first and second retainer portions have a length that is less than a perimeter wall height.

14. The method of protecting a brassiere hook-and-eyelet clasp during laundering of claim 13, wherein the perimeter wall is serrated along a first and second side.

* * * * *